US007626374B2

(12) United States Patent
Haiplik

(10) Patent No.: US 7,626,374 B2
(45) Date of Patent: Dec. 1, 2009

(54) VOLTAGE REFERENCE CIRCUIT

(75) Inventor: Holger Haiplik, Swindon (GB)

(73) Assignee: Wolfson Microelectronics plc, Edinburgh (GB)

( * ) Notice: Subject to any disclaimer, the term of this patent is extended or adjusted under 35 U.S.C. 154(b) by 238 days.

(21) Appl. No.: 11/902,025

(22) Filed: Sep. 18, 2007

(65) Prior Publication Data

US 2008/0224682 A1 Sep. 18, 2008

(30) Foreign Application Priority Data

Oct. 6, 2006 (GB) ..... 0619827.9

(51) Int. Cl.
*G05F 3/16* (2006.01)
*G05F 3/02* (2006.01)

(52) U.S. Cl. ..... 323/313; 323/315; 323/316; 327/539

(58) Field of Classification Search ..... 323/312–317; 327/534, 535, 537–543
See application file for complete search history.

(56) References Cited

U.S. PATENT DOCUMENTS 6,150,872 A * 11/2000 McNeill et al. ..... 327/539
6,160,391 A 12/2000 Banba et al.
6,710,641 B1 3/2004 Yu et al.
6,784,652 B1 8/2004 Aude
6,906,581 B2 6/2005 Kang et al.
6,998,902 B2 * 2/2006 Sugimura ..... 327/539
7,148,672 B1 12/2006 Holmes
7,224,209 B2 * 5/2007 Hsu ..... 327/538
7,531,999 B2 * 5/2009 Chang ..... 323/317

FOREIGN PATENT DOCUMENTS

JP 2003-263232 9/2003

OTHER PUBLICATIONS

M. Waltari, et al., "Reference Voltage Driver for Low-Voltage CMOS A/D Converters," *Proceedings of ICECS 2000*, vol. 1, pp. 28-31, 2000.
P. Malcovati, et al., "Curvature-Compensated BiCMOS Bandgap with 1-V Supply Voltage," *IEEE J. Solid-State Circuits*, vol. 36, pp. 1076-1081, Jul. 2001.
A. Pierazzi et al., "Band-Gap References for near 1-V operation in standard CMOS technology," *IEEE 2001 Custom Integrated Circuit Conference*, pp. 463-466, 2001.
K. N. Leung et al., "A Sub-1-V 15-ppm/° C. CMOS Bandgap Voltage Reference Without Requiring Low Threshold Voltage Device," *IEEE J. Solid-State Circuits*, vol. 37, pp. 526-530, Apr. 2002.
A. Boni, "Op-Amps and Start-up Circuits for CMOS Bandgap References With Near 1-V Supply," *IEEE J. Solid-State Circuits*, vol. 37, pp. 1339-1343, Oct. 2002.
H. Banba et al., "A CMOS Bandgap Reference Circuit with Sub-1-V Operation" *IEEE J. Solid-State Circuits*, vol. 34, No. 5, May 1999.

* cited by examiner

*Primary Examiner*—Matthew V Nguyen
(74) *Attorney, Agent, or Firm*—Dickstein Shapiro LLP

(57) ABSTRACT

A reliable start-up circuit for starting a bandgap type voltage reference generator which ensures that the bandgap reference cell will operate at a stable operating point before the start-up circuit is disabled.

36 Claims, 8 Drawing Sheets

VOLTAGE REFERENCE CIRCUIT

BACKGROUND OF THE INVENTION

The present invention relates to circuits for generating a voltage reference and in particular start-up circuits for generating voltage references using a current-mode bandgap reference.

The bandgap reference circuit is commonly used in integrated circuits for providing reference voltages to devices such as analogue to digital converters, voltage regulators, etc. Bandgap reference circuits provide references with reliable and accurate voltages even in devices where relatively low supply voltages are used. The trend in integrated circuits towards using ever lower supply voltages is so as to derive advantages in terms of increased speed and reduced power consumption. This need for operation at lower voltages leads to a number of issues which limit the ability of conventional voltage reference designs to operate. Traditional voltage-mode designs are unable to work at the lower supply voltages required. FIG. 1 illustrates a voltage-mode bandgap reference cell.

In the circuit shown in FIG. 1, two bipolar transistors Q1, Q2 are each used in a diode connected configuration. One of the transistors, Q2, is designed to be larger by a factor N than the other transistor Q1. Current is provided to the respective transistors Q1 and Q2 by two PMOS transistors MP1 and MP2. These PMOS transistors are arranged as current sources with the respective current that flows through them being controlled by an amplifier A1. Consequently, the currents flowing into the respective emitters of transistors Q1 and Q2 are the same as those flowing from the respective drains of transistors MP1 and MP2. The amplifier A1 is arranged to ensure that the voltages at nodes N1 and N2 are the same. As mentioned above, Q2 is a larger transistor than Q1 and so the current density in Q2 is lower than in Q1. As a result, the voltage across Q2 is lower than the voltage across Q1 due to the lower current density. As a further result, the base/emitter voltage difference between Q1 and Q2 appears across the resistor R1 and the current through R1 is determined according to this voltage difference. Consequently, the voltage $VREF_{VM}$ is determined according to the sum of the voltages across resistors R1 and R2 and the voltage on transistor Q2.

$$\begin{aligned} V_{REF,VM} &= V_{Q2} + V_{R1} + V_{R2} \\ &= V_{Q2} + \frac{(V_{Q1} - V_{Q2})}{R1} \cdot (R1 + R2) \\ &= V_{Q2} + V_T \cdot \ln(N) \cdot \left(1 + \frac{R2}{R1}\right) \end{aligned}$$

$$V_{REF,VM} = V_{Q1} + V_T \cdot \ln(N) \cdot \frac{R2}{R1}$$

where: $V_{Q1}-V_{Q2}=V_T \cdot \ln(N)$; $V_T=k \cdot T/q$; k is Boltzmann's constant; T is the absolute temperature in degrees Kelvin; and q is the magnitude of electronic charge.

The voltage difference between transistors Q1 and Q2 has a positive temperature coefficient whereas the voltage across Q2 has a negative temperature coefficient. These temperature coefficients can be cancelled out by appropriate selection of the resistors R1 and R2. As a result, the voltage reference has a very low temperature dependency.

The circuit of FIG. 1 ideally operates at a stable operating point where current is flowing through the transistors Q1 and Q2. However, this circuit also has a second stable operating point where no current is flowing through the transistors Q1 and Q2. FIG. 2 shows the operational characteristics at nodes N1 and N2 of the circuit of FIG. 1.

The two trace lines in FIG. 2 represent the voltages produced at nodes N1 and N2 in response to the current being sourced by the respective transistors MP1 and MP2. Where the lines coincide, a stable operating point is defined. Consequently, it can be seen that the lines are coincident at zero operating current and at a current, in this particular example, of just over 3 μA, as indicated by the dashed line. This characteristic of having two stable operating points leads to a problem in starting the circuit. If the circuit is simply switched on then it is possible that it will simply remain in the stable zero current operating state. Consequently, the starting of these circuits can be problematic.

In order to start such a circuit correctly, a small start-up current can be injected at the correct node which is then usually enough to overcome the zero current state and lead the circuit towards the desirable stable operating point.

With the voltage-mode arrangement of FIG. 1, the reference voltage is around 1.25V and so the supply voltage must be at least 1.25V.

FIG. 3 shows a current-mode bandgap reference cell which is based upon the voltage-mode bandgap cell illustrated in FIG. 1. In this FIG. 3 arrangement, there is a further PMOS transistor MP3 to provide a current which is used to produce a reference voltage $VREF_{CM}$ across an additional resistor R4. Additional current paths are also introduced via repositioned resistors R2 and R3. These additional current paths provide that the current flowing through the PMOS transistors of the current mirror has a relationship to both $V_{Q1}$ and $V_T$.

$$I_{MP3} = I_{MP2} = \frac{V_{Q1}}{R2} + \frac{V_T \cdot \ln(N)}{R1}$$

$$\begin{aligned} V_{REF,CM} &= I_{MP3} \cdot R4 \\ &= V_{Q1} \cdot \frac{R4}{R2} + V_T \cdot \ln(N) \cdot \frac{R4}{R1} \\ &= \frac{R4}{R2} \cdot \left(V_{Q1} + V_T \cdot \ln(N) \cdot \frac{R2}{R1}\right) \\ &= \frac{R4}{R2} \cdot V_{REF,VM} \end{aligned}$$

This current-mode topology has advantages over the voltage-mode arrangement of FIG. 1. However, the additional current paths through the repositioned resistors R2 and R3 result in additional stable operating points when there is no current flowing in the bipolar transistors. This is demonstrated in FIG. 4.

FIG. 4 shows a linear region where the current flowing from transistors MP1 and MP2 is flowing into the respective resistors R3 and R2, before any current begins to flow in the bipolar transistors Q1 and Q2. When no current is flowing in the bipolar transistors, the current through transistors MP1 and MP2 into resistors R2 and R3 (R2=R3) naturally leads to similar voltages on nodes N1 and N2 and so the circuit is stable. Consequently, in this range, a number of stable operating points can exist in addition to the desirable operating point. In order to deal with this problem, a robust way of starting up the circuit is required.

A number of different ways in which current-mode bandgap reference circuits can be started up have been proposed. However, many of these have drawbacks.

FIG. 5 shows a start-up circuit arrangement for a circuit such as that shown in FIG. 3. The circuit uses a PMOS transistor MP4 to feed current directly into node N1. When the circuit is initially powered on, there is no current flowing in the voltage reference cell formed by the transistors MP1, MP2, Q1, Q2 and resistors R1, R2, R3 and the amplifier A1. Node N1 will thus be close to VSS.

The additional bipolar transistor Q3 and the two resistors R6, R7 in conjunction with the current source CS2 generate a coarse voltage reference VC. This coarse reference voltage VC is compared, using a comparator C1, with the output reference voltage $VREF_{CM}$. Whilst the voltage reference cell is not operating at the desired operating point, the current through MP1, MP2 and hence MP3 will be low. As a result, the voltage generated across R4, $VREF_{CM}$, will be lower than the desired output. Whilst VC is greater than $VREF_{CM}$, the comparator C1 keeps transistor MN5 turned on, which in turn, turns on the transistor MP4 so as to provide current into node N1. Thus, the start-up circuit continues to operate until the output $VREF_{CM}$ exceeds some predetermined threshold. However, this circuit fails to link the operating point of the additional bipolar transistor Q3 to the operating point of the bipolar transistors Q1 and Q2 in the bandgap reference cell. The current source biasing Q3 does not have any feedback from the voltage reference cell. Therefore the operating conditions of Q3 are not linked to those of Q1 and Q2. That means that even if Q3 is biased properly, there is a possibility that Q1 and Q2 are not. Thus again, the circuit does not reliably guarantee start-up.

The circuit described above provides a way of providing a start-up capability to the bandgap reference cell, but in the example above the proper start-up of the voltage reference is not guaranteed. There is therefore a need for a start-up circuit which is better able to ensure that the bandgap reference cell has started operating correctly and is at or tending towards the desired operating point under all circumstances.

It is therefore an aim of the present invention to provide a start-up circuit which will continue to operate until the bandgap reference cell is at or sufficiently close to a desired operating point before turning off. This can be achieved by ensuring that the start-up circuit is only turned off after current has started to flow in the bipolar transistors of the bandgap reference. This means that on the traces shown in FIG. 4, the voltage and currents have passed beyond the initial ramp i.e. the linear region, and away from the undesirable operating points associated with zero current in the bipolar transistors.

However, it is generally difficult to monitor the current through bipolar transistors formed on a substrate fabricated using a CMOS process. FIG. 6 shows a section of a substrate showing how a bipolar transistor is typically formed in such a substrate. A well of N-type material is produced in the P-type substrate. A P-type region is then formed in the N-type well. As shown in FIG. 6, the adjacent PNP layers form a parasitic PNP bipolar device which can be used as the basis for a bandgap reference circuit. However, because the collector of the transistor is formed by the substrate, it is difficult to measure the device collector current. Current flowing through the bipolar device passes into the substrate and so cannot be differentiated from other currents flowing into the substrate without isolating the bipolar collector from the rest of the substrate. Additionally, measuring the current through the bipolar device is difficult without disturbing the operation of the voltage reference cell.

SUMMARY OF THE INVENTION

Therefore, according to the present invention, there is provided a reference current generator comprising: a current generator comprising a plurality of p-n junction elements for providing said reference current; a current injector arranged to provide a control current to a first node of said current generator for increasing the magnitude of said reference current; and a comparator arranged to provide a control signal based upon comparing the difference between a first voltage derived from the voltage across one of the p-n junction elements and a second voltage proportional to the reference current, said difference being indicative of the current in said one of the p-n junctions, wherein said current injector is controlled by said control signal to provide current to said first node whilst the current in said one of the p-n junctions is below a predetermined level.

The current generator preferably comprises a resistance element in series with one of said p-n junction elements.

The present invention also provides a reference current generator comprising: a current generator comprising a plurality of p-n junction elements for providing said reference current; a current injector arranged to provide a control current to a first node of said current generator for increasing the magnitude of said reference current; a resistance element in series with one of said p-n junction elements; and a comparator arranged to provide a control signal based upon comparing the voltage across said resistance element to a predetermined level, said voltage being indicative of the current in said one of the p-n junctions, wherein said current injector is controlled by said control signal to provide current to said first node whilst the voltage across said resistance element is below said predetermined level.

Preferably, the p-n junction elements are provided as two separate elements. The first element comprises one or more p-n junctions arranged in parallel with each other. The second element similarly comprises one or more p-n junctions arranged in parallel with each other and including the p-n junction in series with the resistive element. The total emitter area of the one or more p-n junctions in said first element is preferably less than the total emitter area of the one or more p-n junctions in said second element.

The current generator preferably comprises a current mirror arranged to provide substantially identical currents to said first element, to said second element and as the output reference current from the device.

Advantageously, said first node is provided on one of said p-n junction elements to provide current to the p-n junction element. The current generator is preferably formed as a bandgap voltage reference circuit.

The present invention also provides a start-up controller for a bandgap reference cell having a first voltage reference element comprising a first voltage reference device and a second voltage generating element comprising a second voltage reference device arranged in series with a resistance element, wherein said start-up controller comprises: a comparator arranged to provide a control signal by comparing the voltage on a node of said bandgap reference cell with a voltage proportional to an output reference current generated by said bandgap reference cell, said measured voltage difference corresponding to the current through one of said first or second voltage reference elements; and a current injector arranged to provide current to one of said first and second voltage reference elements whilst said measured voltage difference is below a predetermined level.

The present invention further provides a start-up controller for a bandgap reference cell having a first voltage reference element comprising a first voltage reference device and a second voltage generating element comprising a second voltage reference device arranged in series with a resistance element, wherein said start-up controller comprises: a comparator arranged to provide a control signal by comparing the voltage across said resistance element to determine if it exceeds a predetermined value, said measured voltage difference corresponding to the current through the second voltage reference elements; and a current injector arranged to provide current to one of said first and second voltage reference elements whilst said measured voltage is below said predetermined level.

The comparator preferably includes a predetermined offset. This means that the output only switches state when the voltage on one of the inputs exceeds the voltage on the other by the offset amount.

The present invention additionally provides a start-up controller for a voltage reference circuit having first and second voltage reference devices, the circuit having a first stable operating state and one or more other stable operating states in which the current flowing through the first and second voltage reference devices is below a predetermined level, the start-up controller comprising: a current monitor arranged to determine if a device current in one of said voltage reference devices is below a predetermined threshold comprising comparing a voltage proportional to the voltage across one of the first and second voltage reference devices with a voltage proportional to the output voltage of said voltage reference circuit; a current injector arranged to inject current to an injection node of said voltage reference circuit to cause the current in said voltage reference devices to increase, wherein said current injector injects current whilst said device current is determined to be below said predetermined threshold.

The voltage proportional to the output voltage of the voltage reference circuit is preferably provided by a voltage divider arranged to provide a fixed proportion of the output voltage. The voltage proportional to the voltage across the one of the first and second voltage reference devices circuit is preferably provided by a voltage divider arranged to provide a fixed proportion of the voltage across the one of the first and second voltage reference devices.

Beneficially, one of the first and second voltage reference devices also includes a resistance element in series with it.

The present invention may further provide a start-up controller for a voltage reference circuit having first and second voltage reference devices, the circuit having a first stable operating state and one or more other stable operating states in which the current flowing through the first and second voltage reference devices is below a predetermined level, the start-up controller comprising: a current monitor arranged to determine if a device current in one of said voltage reference devices is below a predetermined threshold comprising determining said device current by reference to a voltage across a resistive element in series with said one of said first and second voltage reference devices; a current injector arranged to inject current to an injection node of said voltage reference circuit to cause the current in said voltage reference device to increase, wherein said current injector injects current whilst said device current is below said predetermined threshold.

In the above start-up controllers, the voltage reference devices are preferably p-n junction devices. More preferably, they are bandgap voltage reference devices.

The voltage reference circuit may further comprise a resistance element in parallel with each of said voltage reference devices. It may additionally include a current source for producing mirrored currents to said first voltage reference device, said second voltage reference devices and a reference current output; and an amplifier arranged to control said current source to maintain the voltage across the first and second voltage reference devices at the same level.

Preferably, the present invention is embodied in an integrated circuit device.

BRIEF DESCRIPTION OF THE DRAWINGS

The present invention will now be described in more detail by reference to the drawings, in which.

DETAILED DESCRIPTION OF THE INVENTION

Figure 7:
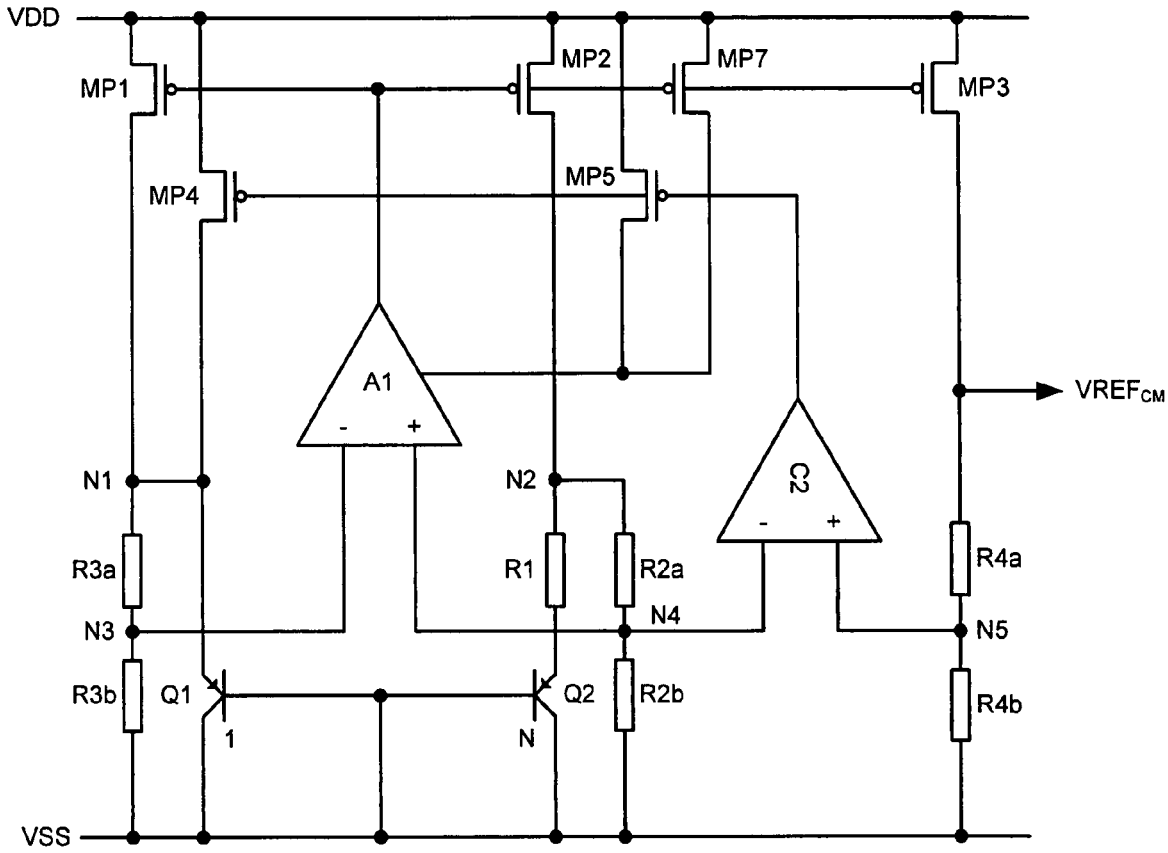
FIG. 7 shows a current mode bandgap reference cell with a start-up circuit according to the present invention.

FIG. 7 shows a current-mode bandgap reference circuit with an associated start-up circuit. The basic bandgap reference cell is similar to those shown in the preceding examples. This consists of two bipolar transistors Q1 and Q2 arranged in a diode connected configuration. Transistor Q2 is arranged to be a physically larger device than Q1, having an emitter area compared to that of Q1 which is N times bigger. Transistor Q1 connects node N1 to the lower supply rail VSS, whereas Q2 connects node N2 to the lower supply rail via resistor R1.

Nodes N1 and N2 are also connected to ground via resistors R3 and R2 respectively. In the circuit in FIG. 7, resistors R3 and R2 are divided into pairs of resistors (R3*a*, R3*b* and R2*a*, R2*b*) each forming a resistor divider network. This is not essential to the operation of the device and simply allows the input voltages to the amplifier A1 to be lower than if the inputs were connected directly to the nodes N1 and N2. The use of these resistor divider networks can be useful for lower voltage operation. However, it should be understood that the resistors R2*a* and R3*a* could be dispensed with such that the amplifier inputs were connected directly to the nodes N1 and N2.

Furthermore, additional resistors (not illustrated) may be provided between node N1 and transistor MP1 and also between node N2 and transistor MP2. In this situation, the amplifier inputs could alternatively be connected between the resistors and the respective transistors MP1 and MP2.

When the bandgap reference cell starts to operate, current from transistors MP1 and MP2 starts to flow into nodes N1 and N2 respectively. Transistors MP1 and MP2 are of the same size and therefore the current into nodes N1 and N2 is the same. Initially, all the current flowing into nodes N1 and N2 passes through resistors R3*a* and R3*b* from node N1 and R2*a* and R2*b* from node N2. As the current into the nodes N1 and N2 increases, the voltage at these nodes increases. Initially the voltage at N1 and N2 is lower than the base-emitter voltage of the transistors Q1 and Q2 and so no significant current flows through the transistors. Eventually the voltages at nodes N1 and N2 will be sufficiently high that the transistors Q1 and Q2 will start to conduct. The voltage on node N1 will then be equivalent to the base-emitter voltage of Q1.

In the example given, the ratios of resistors R3*a* to R3*b* and R2*a* to R2*b* are the same. Consequently, the voltage on nodes N3 and N4 represent the same proportions of the voltages on nodes N1 and N2. The amplifier A1 operates to control the transistors MP1 and MP2 such that the voltages on the nodes N3 and N4 and hence the voltages on nodes N1 and N2 are the same. As a result, the voltage on node N2 will also be the same as the base-emitter voltage of transistor Q1. The voltage across R1 will therefore be the difference between the base-emitter voltage of Q1 and the base-emitter voltage of Q2.

$$V_{R1}=V_{Q1}-V_{Q2}.$$

Consequently, the current (I) flowing through transistor MP2 will be the sum of the currents flowing through resistors R2*a* and resistor R1:

$$I = I_{R1} + I_{R2a}$$

$$I = \frac{V_{R1}}{R1} + \frac{V_{Q1}}{(R2a + R2b)} = \frac{V_{R1}}{R1} + \frac{V_{Q1}}{R2}$$

$V_{R1}$ has a positive temperature coefficient whereas $V_{Q1}$ has a negative temperature coefficient. Current I is mirrored to the transistor MP3 which passes through resistor R4 to provide the current-mode voltage reference, $VREF_{CM}$. The level of this voltage reference can be adjusted by adjusting the value of R4 accordingly. In this arrangement, the resistor R4 is divided into two parts (R4*a*, R4*b*) to form a resistor divider network in a similar way to resistors R2 and R3. The ratio of the resistors R4*a* to R4*b* is similar to the ratio of resistors R2*a* to R2*b* in this arrangement.

The operation of the start-up circuit will now be described. The start-up circuit is similar to the circuit described above, in that it uses a transistor MP4 to inject current into node N1 in order to provide current to one side (N3) of the bandgap reference cell and cause the inputs to the amplifier A1 to be offset. This differential input (N3, N4) to the amplifier brings the amplifier output down low, thereby reducing the voltage on the common gate connection for the transistors MP1, MP2, MP3 and MP7. This in turn increases the current into nodes N1 and N2 to start the process of switching the bandgap reference cell on.

Initially in the zero current condition, the voltage on the nodes N4 and N5 which provide the inputs to the comparator C2 will be substantially the same as the lower supply rail VSS. As a result, the inputs to the comparator C2 will be substantially the same. In order to ensure that the comparator provides a suitable output, it can be provided with an offset between its inputs. Therefore, when the input voltages to the comparator C2 are identical, the comparator, because of the offset, operates as if it has a small negative input. This input offset results in the output of the comparator controlling the transistors MP4 and MP5 and pulling down their gate terminals thus causing them to turn on. This causes current to be fed into node N1 beginning the start-up operation. It should be noted that the offset can be produced in a number of different ways such as: designing the comparator to have the offset between its terminals; or connecting a current source to provide a "trickle" current to one of the terminals.

As indicated above, the current fed into node N1 by transistor MP4 causes the voltage on node N1 and hence N3 to rise. This causes an offset between the amplifier inputs since node N4 remains substantially at the lower supply voltage VSS level since no current initially flows through MP2. Whilst the amplifier A1 may have its own random offset due to fabrication variations, the difference on the inputs should be sufficiently large to overcome any such offset and so cause the amplifier to provide an output to switch on transistors MP1 and MP2.

Initially, the current through MP2 flows to node N2 and then through resistors R2*a* and R2*b*. Whilst the current delivered by transistor MP2 is less than $V_{be(Q2)}/(R2a+R2b)$ no current will flow through resistor R1 into transistor Q2. If the start-up circuit was to be disabled at this stage, the bandgap reference cell is likely to end up at a stable but undesirable operating point, with no current flowing through the bipolar transistors. Assuming that R2*a* and R3*a* were the same value and also that R2*b* and R3*b* were also the same value then nodes N1 and N2 would be at the same voltage and consequently nodes N3 and N4 would be at the same voltage (also assuming that MP1 and MP2 are the same size i.e. have the same aspect ratio W/L). In this situation, the amplifier A1 would have no input offset. Consequently, the circuit would be at a stable operating point. In reality, fabrication variations would tend to mean that the resistors would not all be of corresponding values and random offsets in the inputs to the amplifier would lead to slight variations in all these parameters. Consequently, the circuit could end in any number of different states depending upon the size of these variations. Consequently, it would be undesirable for the start-up circuit to switch off at this point.

In the circuit of FIG. 7, resistor R4*b* and resistor R2*b* are arranged to be of a similar value. Similarly, transistors MP2 and MP3 are also arranged to be a similar size. Before current starts to flow through Q2, all the current flowing through MP2 flows through R2*b* and the same current, flowing through MP3, flows through R4*b*. As a result, the voltages at nodes N4 and N5 will be the same. With the systematic offset in the comparator C2, its output will continue to maintain MP4 in conduction. This will continue to feed current into node N1, maintaining the offset on the voltages on nodes N3 and N4. This will continue to drive the amplifier A1 further into conduction switching the transistors MP1, MP2 and MP3 on harder. As the current through transistors MP1 and MP2 increases, the voltage on resistor R2 (R2*a*+R2*b*) will eventually exceed voltage $V_{be(Q2)}$ of transistor Q2 and current will begin to flow through resistor R1 into Q2.

As all the current flowing from MP2 is no longer flowing through resistor R2*b* because some is diverted through resistor R1, the voltage on node N4 will now rise more slowly as the current through MP2 increases. However, the voltage on node N5 will continue to rise at its original rate. In other words, an increase in the current through MP2 and MP3 will cause a smaller increase in the voltage across R2*b* than it will the voltage across R4*b*. Consequently, the offset on the inputs to the comparator C2 will no longer be zero and will start to become positive as the input on the non-inverting input (N5) increases above that on the inverting input (N4). This will continue until the voltage difference between the nodes N5 and N4 is equivalent to the systematic offset of the comparator C2. At this point, the comparator output will start to rise and eventually turn off transistors MP4 and MP5.

The arrangement of the circuit of FIG. 7 is such that the voltage difference between nodes N4 and N5 corresponds to the current flowing through transistor Q2 multiplied by the resistance of resistor R2*b*.

$$V_{N5}=I.R4b$$

$$V_{N4}=(I-I_{Q2}).R2b$$

$$\Delta V=V_{N5}-V_{N4}=I.R4b-(I-I_{Q2}).R2b$$

As R2b=R4b, $$\Delta V=I_{Q2}.R2b$$

In other words the comparator C2 remains switched on until the current through transistor Q2 is equivalent to the systematic input offset of the comparator divided by resistor R2*b*. This means that the start-up circuit only turns off after a predetermined current is flowing through the transistor Q2.

Figure 4:
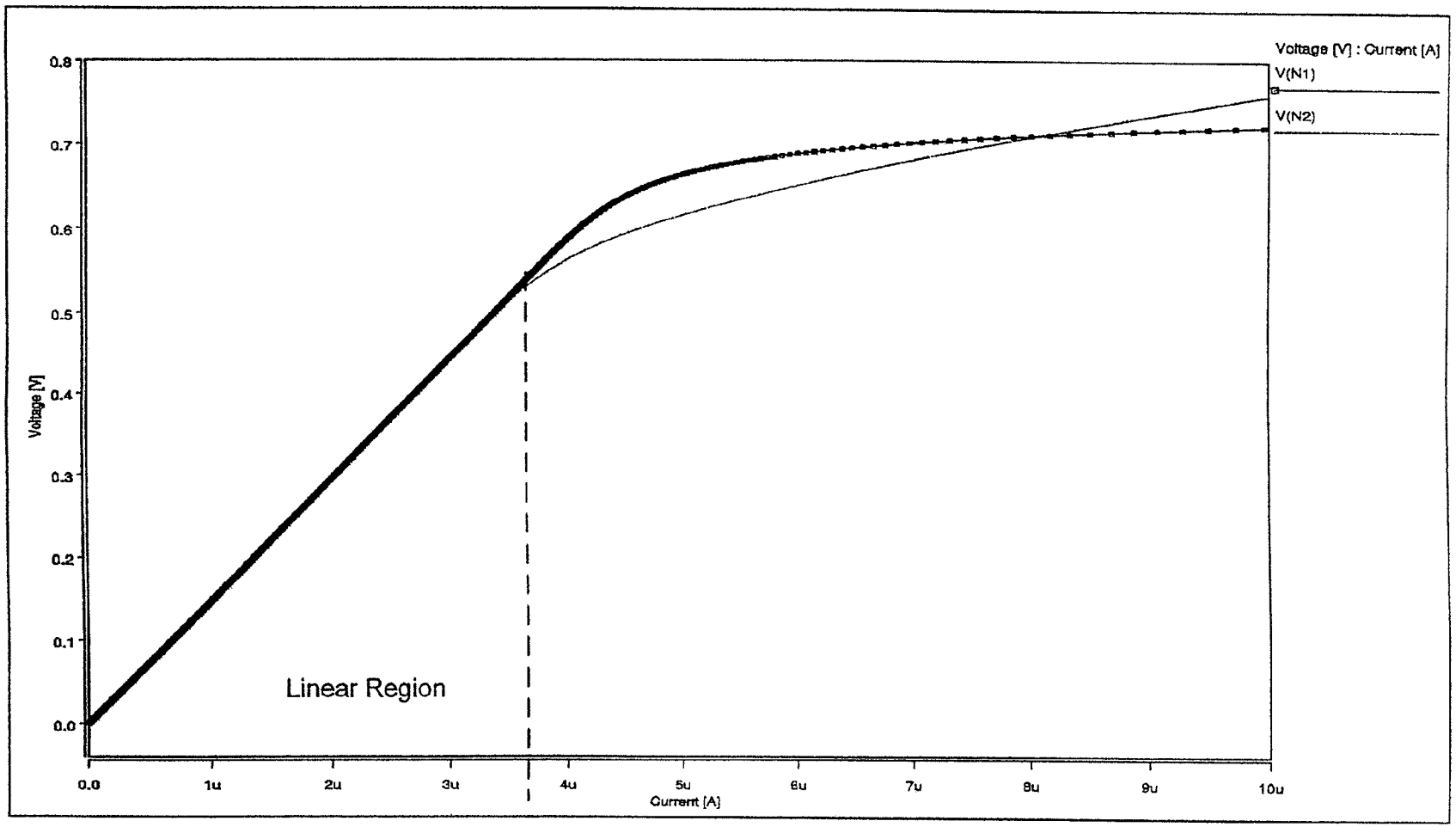
Figure 4 Prior Art
FIG. 4 shows the current-to-voltage characteristics of two nodes of the bandgap reference cell of FIG. 3.
Figure 5:
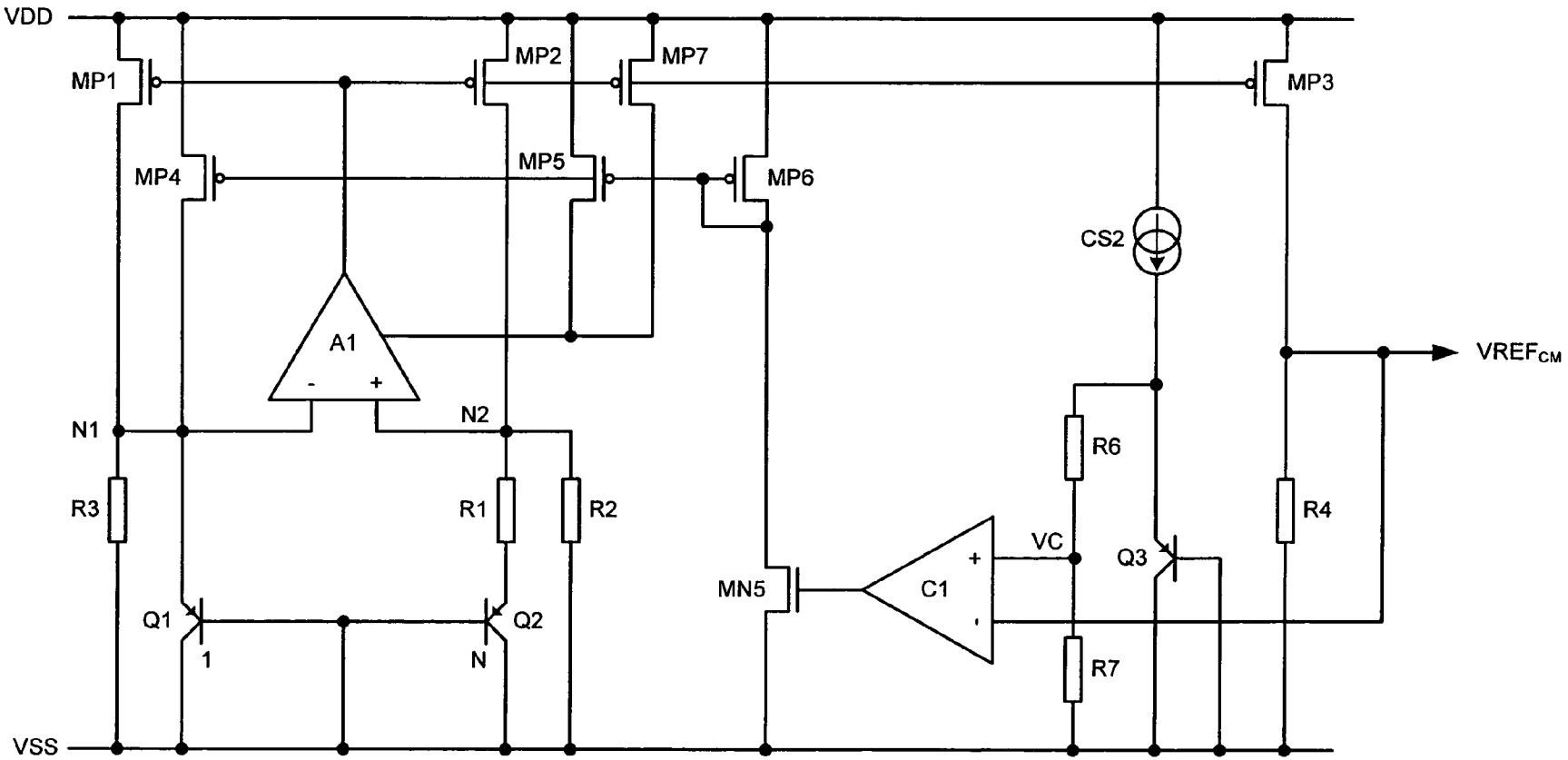
Figure 5 (PRIOR ART)
FIG. 5 shows a start-up circuit for a current-mode bandgap reference cell.
Figure 6:
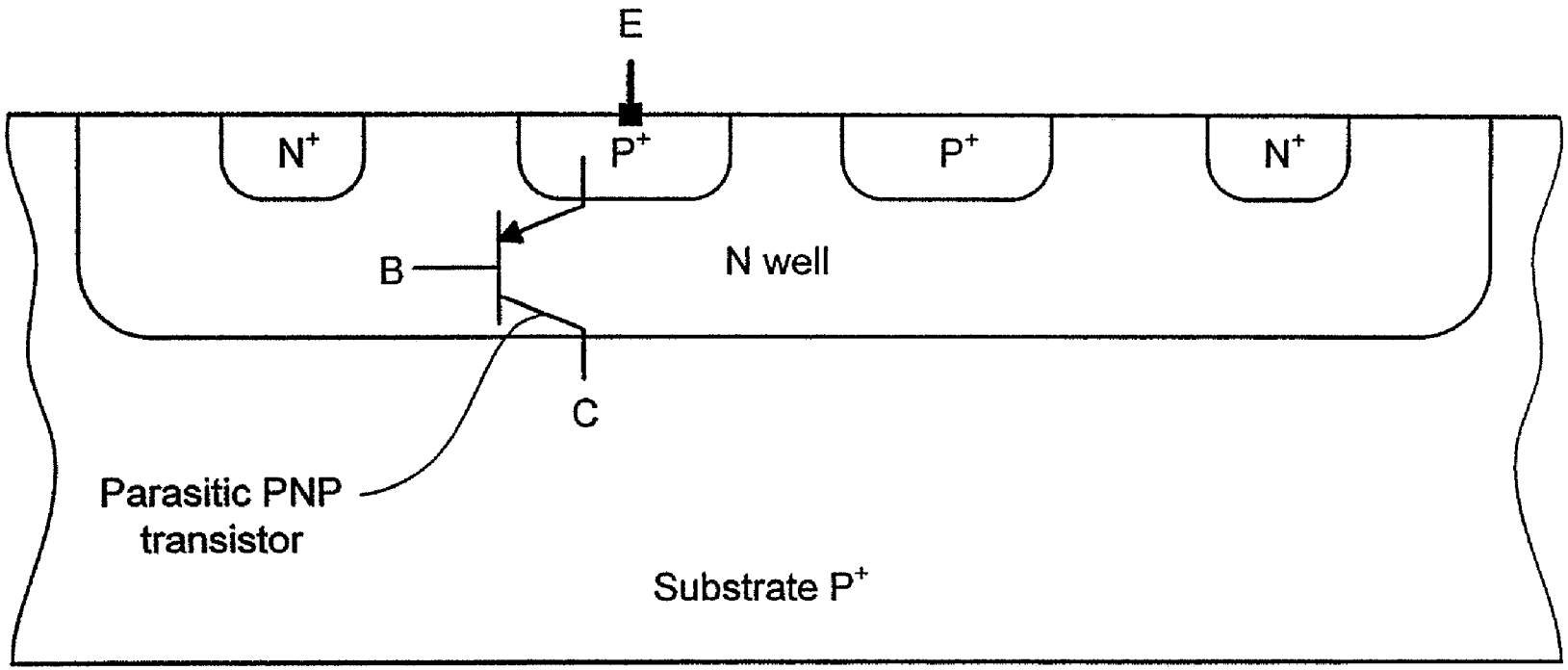
Figure 6 Prior Art
FIG. 6 shows a section of a semiconductor substrate used for forming a PNP bipolar transistor.

The current flowing through transistors Q1 and Q2 will be different whilst the start-up circuit is providing current from MP4 and so the voltage on nodes N3 and N4 will be inherently different. Referring to the diagram shown in FIG. 4, the curve shows the relationship between voltage and current for the two nodes N1 and N2. By adding additional current to the node N1 from the transistor MP4, same current is not provided to each node. If the current on the bottom of the graph is taken to be the current I from the transistors MP1 and MP2, then the curve, for voltage node N1 will effectively be shifted to the left by an amount corresponding to the current provided by MP4. For example, if the current from MP1 and MP2 is 4 μA and the current from MP4 is 1 μA then node N1 would be receiving 5 μA when node N2 is receiving 4 μA. Looking at the 4 μA value on the x-axis of the graph of FIG. 4, would give the voltage on N2 but it would be necessary to move the curve for N2 across to the left by an amount corresponding to 1 μA to compare the equivalent voltage on N1.

Figure 1:
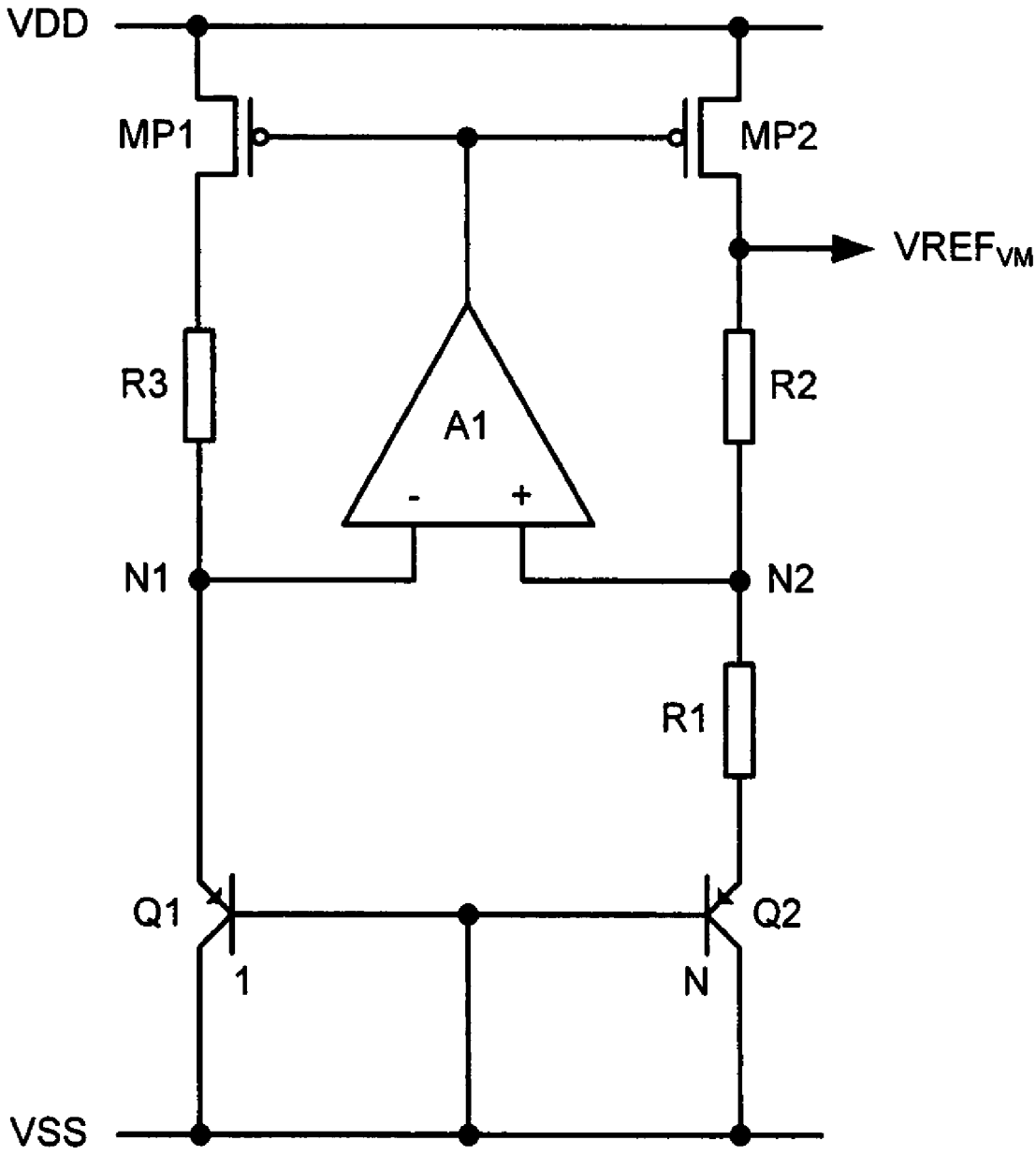
Figure 1 (PRIOR ART)
FIG. 1 shows a conventional voltage-mode bandgap reference cell.
Figure 2:
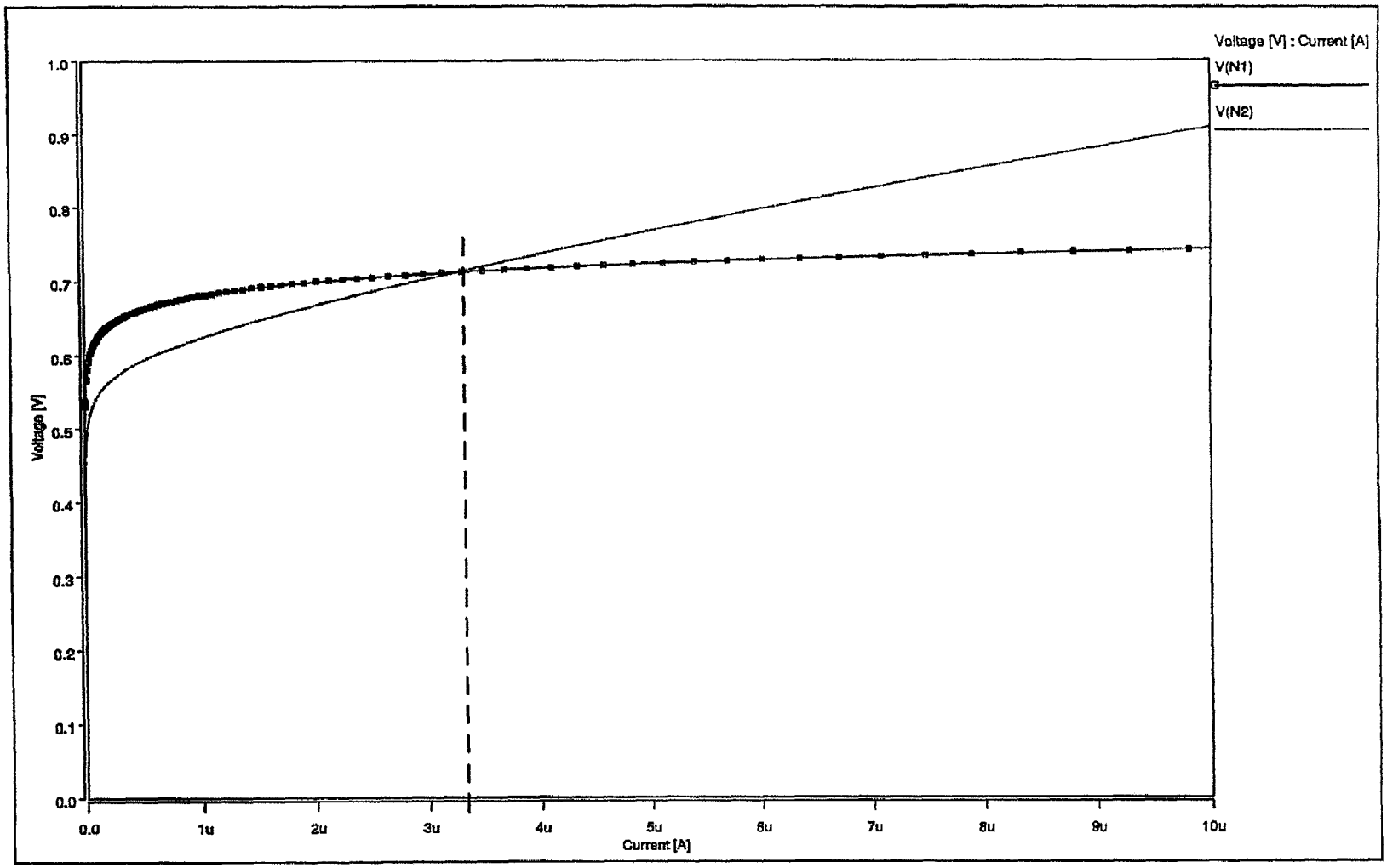
Figure 2 Prior Art
FIG. 2 shows the current-to-voltage characteristics of two nodes of the bandgap reference cell of FIG. 1.
Figure 3:
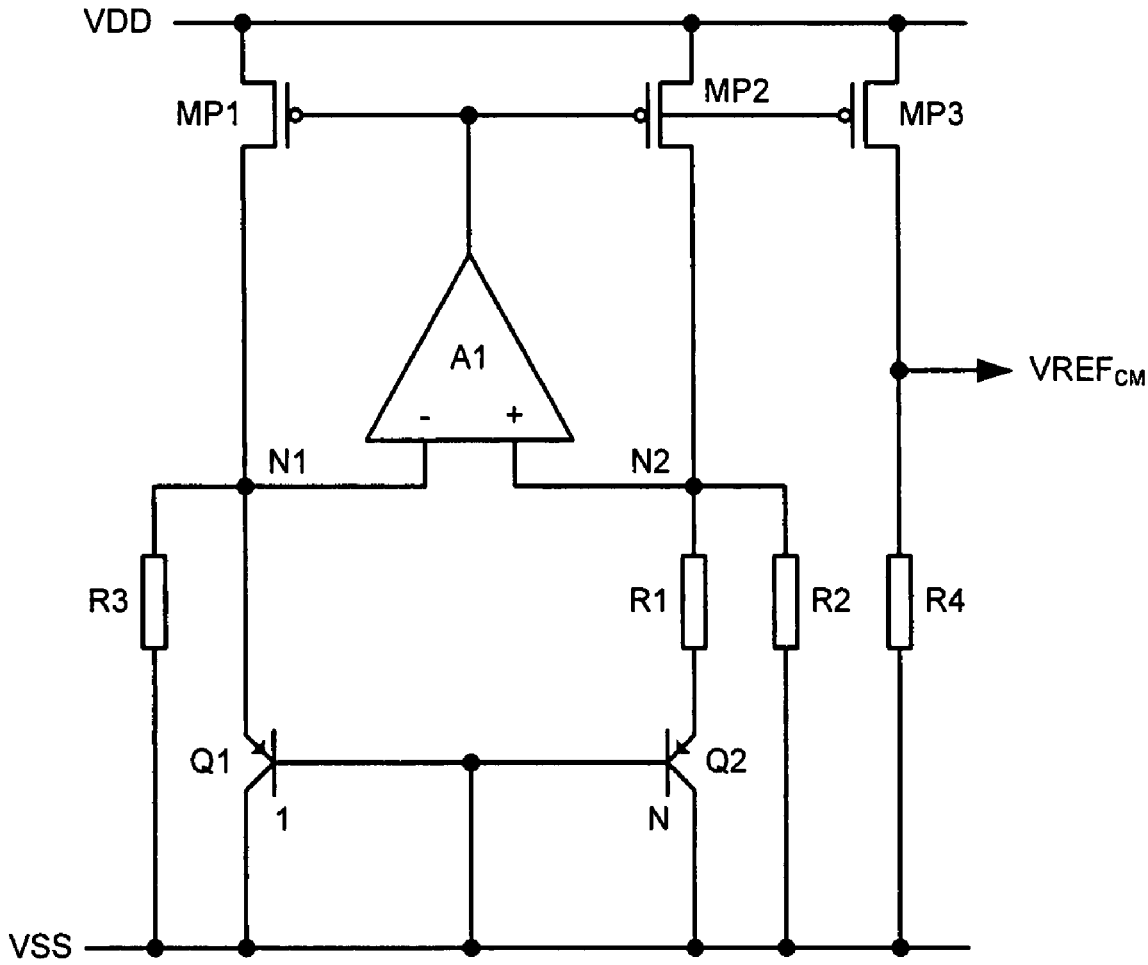
Figure 3 (PRIOR ART)
FIG. 3 shows a diagram of a current-mode bandgap reference cell.

This will lead to a stable operating point (where the voltages on N1 and N2 are equal) somewhere to the left of the stable operating point shown where the curves intersect around the 8 μA level but outside of the linear region. Once the current reaches this level, the current will stop increasing since the operating point is stable. It is important that the start-up circuit is turned off before the bandgap reference cell reaches this stable operating point, otherwise the start-up circuit will not work correctly. If the start-up circuit only turns off when the circuit has exceeded the desired operating point (at approximately 8 μA in FIG. 4), then the amplifier A1 in the voltage reference will act to reduce the current of transistors MP1 and MP2, as per the circuit of FIG. 3, turning them off. If the start-up circuit now turns off, the circuit is likely to drop back to the zero-current state or one of the other undesired operating points. Whilst the start-up circuit is operating, the output $VREF_{CM}$ is not at the desired voltage level.

It is therefore arranged so that the start-up circuit turns off at a voltage below the stable operating point. This is achieved by making sure that the systematic offset of the comparator C2 is smaller than the voltage difference between nodes N4 and N5 at the desired operating point. To allow for variations in the offset voltage of the comparator C2 and the other components it should be ensured that the systematic offset of the comparator C2 is smaller than the minimum possible voltage difference between the nodes N4 and N5 at the desired operating point.

Due to the temperature compensation of the circuit, the voltage $VREF_{CM}$ and hence the voltage at node N5 will be independent of temperature. The voltage on node N4 is proportional to the voltage on node N2 which, due to the amplifier A1, is equivalent to the voltage on node N1 which relates to the voltage $V_{Q1}$. Voltage $V_{Q1}$ has a negative temperature coefficient. Therefore, as the temperature of the circuit rises, the voltage difference between N4 and N5 will increase and hence the minimum voltage difference between nodes N4 and N5 will occur at the minimum operating temperature of the bandgap reference cell.

The above-described circuit provides a start-up current to bring the bipolar transistors Q1, Q2 of the bandgap reference cell into conduction and then bring the bandgap reference cell close to the desired stable operating point. As the cell approaches the stable operating point, the start-up circuit switches off. Consequently, the start-up circuit only switches off after the bipolar transistors Q1, Q2 of the bandgap reference cell have begun to conduct but before the stable operating point is reached. This ensures reliable start-up of the bandgap reference cell whilst ensuring that the start-up circuit turns off correctly to ensure proper operation of the voltage reference circuit.

In the invention shown in FIG. 7, the inverting input of the comparator C2 is connected to node N4. However, the inverting input of the comparator could be connected to node N3. The ratio of resistors R4*a* to R4*b* is not limited to any particular value and node N5 could be connected directly to the output $VREF_{CM}$. The node N5 could even be connected to a higher voltage than $VREF_{CM}$ where a resistor is provided between the output of $VREF_{CM}$ and the drain of transistor MP3.

Under normal operating conditions, transistor MP7 provides a bias current to the amplifier A1. Again, during start-up, the transistor MP5 is turned on to provide a bias current to the amplifier A1. This means the reference cell is self biased and does not need any other circuit for it to operate. The amplifier A1 as well as the comparator C2 may be self-biased or receive their bias from different circuits.

Figure 8:
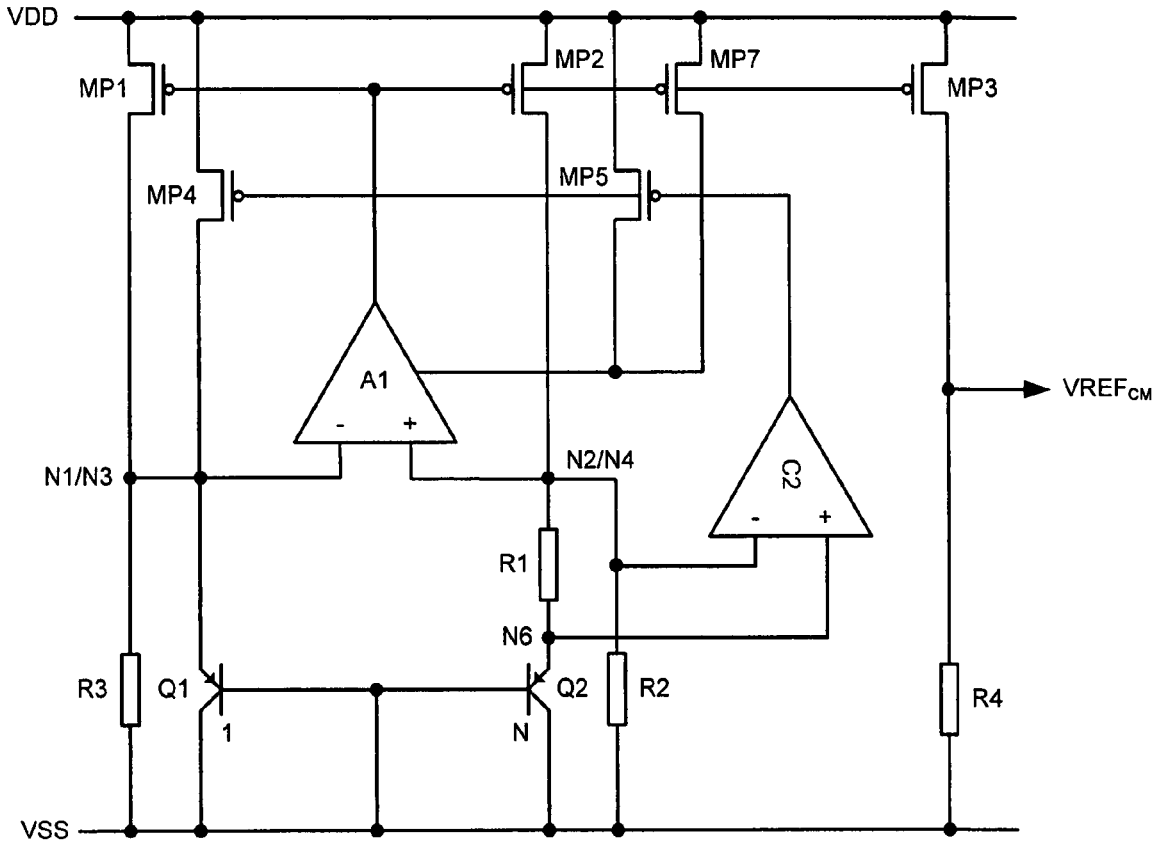
FIG. 8 shows a current mode bandgap reference cell with an alternative start-up circuit in accordance with the present invention.

An alternative arrangement of the start-up circuit will now be described by reference to FIG. 8. The bandgap reference cell shown in FIG. 8 is slightly different to that shown in FIG. 7 in that resistors R2 and R3 are not divided into two parts and the nodes N3 and N4 are connected directly to the nodes N1 and N2, respectively. Additionally, the comparator C2 is connected between node N2 and node N6 which lies between the emitter junction of the transistor Q2 and the resistor R1.

In this arrangement, the comparator inputs monitor the voltage across the resistor R1. Initially, in the zero current state, the voltage across R1 is zero and so the voltage difference between the inputs of the comparator C2 is also zero. The comparator C2 again has a systematic input offset which means that the output of the comparator is low in order to switch on transistors MP4 and MP5. The circuit then operates in a similar manner to that of FIG. 7 with the current through MP4 being fed into node N1 causing the voltage at node N1 to rise and turning on the amplifier A1 to bring transistors MP1 and MP2 into conduction.

Initially the current flowing into nodes N1 and N2 flows through resistors R3 and R2 respectively. This continues until the voltage at node N2 exceeds the base emitter voltage of Q2. At this point, current starts to flow through R1 as transistor Q2 starts to conduct current. The current through R1 causes a voltage to be developed across R1 and this voltage is reflected in the inputs of the comparator C2. As the current through the transistors MP1 and MP2 increases, the voltage across R1 rises until it is equivalent to the systematic input offset of the comparator. At that point, the output of the comparator goes high switching off the transistors MP4 and MP5.

As with the arrangement of FIG. 7, it is important to make sure that the start-up circuit switches off before the bandgap reference cell reaches its stable operating point. This can be achieved by selecting a systematic input offset of the comparator C2 to be smaller than the smallest voltage difference (allowing for fabrication variations in the size of the components) between nodes N2 and N6 of the desired operating point. Assuming that MP1 and MP2 are the same size and the bipolar transistors Q1 and Q2 are sized in a ratio 1:N the voltage difference between the base emitter voltages of Q1 and Q2, which is reflected across R1, will be $[V_T \cdot \ln(N)]$, where $V_T$ is the PTAT (proportional to absolute temperature) voltage or thermal voltage. This thermal voltage has a positive temperature coefficient and so will be at a minimum when the circuit is at the minimum operating temperature. Consequently, the minimum voltage between N2 and N6 will occur when the circuit is operating at the minimum operating temperature. Thus the systematic input offset of the comparator C2 will be selected according to component tolerances for the minimum operating temperature of the device.

Again, the voltage across R1 only begins to rise once current starts to flow through bipolar transistor Q2 and so the comparator C2 only switches off the start-up circuit after current has started to flow through the bipolar transistor but before the stable operating point is reached.

The arrangement of FIG. 8 again provides a bias current for the amplifier A1. MP5 provides an initial bias current by the start-up circuit which is replaced by the bias current provided by MP7 when the bandgap reference is operating normally. As with FIG. 7, the amplifier A1 as well as the comparator C2 may be self-biased or receive their bias from different circuits.

In the arrangements of FIGS. 7 and 8, current is injected into node N1 using transistor MP4. However, as an alternative, the common gates of MP1, MP2 and MP3 may be pulled low to drive these transistors into conduction and thereby feed current into the bandgap reference cell.

The transistors Q1 and Q2 in the embodiments described above are shown and described as bipolar transistors. However, it will be understood that these are equivalent to and can be replaced by forward biased diodes.

The above embodiments operate to start up the voltage cell reference by introducing additional current into the node N1 using transistor MP4. However, it is possible to operate the present invention by using the comparator C2 to reduce the voltage on the common gate of MP1, MP2, MP3 to force these devices into conduction and to bring the voltage reference cell to its normal stable operating point. However, it is preferable to provide current into only one of the nodes N1 or N2, as described in the embodiments above, since this ensures there is a voltage difference across the inputs to the amplifiers earlier in the start-up process.

The invention has been described above in terms of specific embodiments. It should be noted that the above described embodiments illustrate rather than limit the invention, and that those skilled in the art will be able to design many alternative embodiments without departing from the scope of the appended claims and drawings. The word "comprising" does not exclude the presence of elements or steps other than those listed in a claim, "a" or "an" does not exclude a plurality, and a single element may fulfil the functions of several elements recited in the claims. Any reference signs in the claims shall not be construed so as to limit their scope.

What is claimed is:

1. A reference current generator comprising:

a current generator comprising a plurality of p-n junction elements for providing said reference current;

a current injector arranged to provide a control current to a first node of said current generator for increasing the magnitude of said reference current; and a comparator arranged to provide a control signal based upon comparing the difference between a first voltage derived from the voltage across one of the p-n junction elements and a second voltage proportional to the reference current, said difference being indicative of the current in said one of the p-n junctions, wherein said current injector is controlled by said control signal to provide current to said first node while the current in said one of the p-n junctions is below a predetermined level.

2. A reference current generator according to claim 1 further comprising a resistance element in series with one of said p-n junction elements.

3. A reference current generator comprising:

a current generator comprising a plurality of p-n junction elements for providing said reference current;

a current injector arranged to provide a control current to a first node of said current generator for increasing the magnitude of said reference current;

a resistance element in series with one of said p-n junction elements; and a comparator arranged to provide a control signal based upon comparing the voltage across said resistance element to a predetermined level, said voltage being indicative of the current in said one of the p-n junction elements, wherein said current injector is controlled by said control signal to provide current to said first node while the voltage across said resistance element is below said predetermined level.

4. A reference current generator according to claim 2 wherein said p-n junction elements are arranged as:

a first element comprising one or more p-n junctions arranged in parallel and a second element comprising one or more p-n junctions arranged in parallel and including said p-n junction element in series with said resistive element, wherein the total emitter area of the one or more p-n junctions in said first element is less than the total emitter area of the one or more p-n junctions in said second element.

5. A reference current generator according to claim 4 further comprising a current mirror arranged to provide substantially identical currents: to said first element; to said second element; and as said reference current output.

6. A reference current generator according to claim 3 wherein said p-n junction elements are arranged as:

a first element comprising one or more p-n junctions arranged in parallel and a second element comprising one or more p-n junctions arranged in parallel and including said p-n junction element in series with said resistive element, wherein the total emitter area of the one or more p-n junctions in said first element is less than the total emitter area of the one or more p-n junctions in said second element.

7. A reference current generator according to claim 6 further comprising a current mirror arranged to provide substantially identical currents: to said first element; to said second element; and as said reference current output.

8. A reference current generator according to claim 1 wherein said first node is provided on one of said p-n junction elements to provide current to the p-n junction element.

9. A reference current generator according to claim 3 wherein said first node is provided on one of said p-n junction elements to provide current to the p-n junction element.

10. A reference current generator according to claim 1 wherein said current generator is a bandgap voltage reference circuit.

11. A reference current generator according to claim 2 wherein said current generator is a bandgap voltage reference circuit.

12. A reference current generator according to claim 3 wherein said current generator is a bandgap voltage reference circuit.

13. A start-up controller for a bandgap reference cell having a first voltage reference element comprising a first voltage reference device and a second voltage reference element comprising a second voltage reference device arranged in series with a resistance element, wherein said start-up controller comprises:

a comparator arranged to provide a control signal by comparing the voltage on a node of said bandgap reference cell with a voltage proportional to an output reference current generated by said bandgap reference cell, said measured voltage difference corresponding to the current through one of said first or second voltage reference elements; and a current injector arranged to provide current to one of said first and second voltage reference elements while said measured voltage difference is below a predetermined level.

14. A start-up controller according to claim 13 wherein said voltage reference devices are p-n junction devices.

15. A start-up controller according to claim 13, wherein said first and second voltage reference devices are bandgap voltage reference devices.

16. A start-up controller according to claim 13, wherein said voltage reference circuit further comprises:

a resistance element in parallel with each of said voltage reference elements;

a current source for producing mirrored currents to said first voltage reference device, said second voltage reference device and a reference current output; and an amplifier arranged to control said current source to maintain the voltage across the first and second voltage reference devices at the same level.

17. A start-up controller for a bandgap reference cell having a first voltage reference element comprising a first voltage reference device and a second voltage reference element comprising a second voltage reference device arranged in series with a resistance element, wherein said start-up controller comprises:

a comparator arranged to provide a control signal by comparing the voltage across said resistance element to determine if it exceeds a predetermined value, said measured voltage difference corresponding to the current through the second voltage reference element; and a current injector arranged to provide current to one of said first and second voltage reference elements while said measured voltage is below said predetermined level.

18. A start-up controller according to claim 17 wherein said voltage reference devices are p-n junction devices.

19. A start-up controller according to claim 17, wherein said first and second voltage reference devices are bandgap voltage reference devices.

20. A start-up controller according to claim 17, wherein said voltage reference circuit further comprises:

a resistance element in parallel with each of said voltage reference elements;

a current source for producing mirrored currents to said first voltage reference device, said second voltage reference device and a reference current output; and an amplifier arranged to control said current source to maintain the voltage across the first and second voltage reference devices at the same level.

21. A start-up controller according to claim 13 wherein the comparator includes a predetermined offset.

22. A start-up controller according to claim 17 wherein the comparator includes a predetermined offset.

23. A start-up controller for a voltage reference circuit having first and second voltage reference devices, the circuit having a first stable operating state and one or more other stable operating states in which the current flowing through the first and second voltage reference devices is below a predetermined level, the start-up controller comprising:

a current monitor arranged to determine if a device current in one of said voltage reference devices is below a predetermined threshold comprising comparing a voltage proportional to the voltage across one of the first and second voltage reference devices with a voltage proportional to the output voltage of said voltage reference circuit;

a current injector arranged to inject current to an injection node of said voltage reference circuit to cause the current in said voltage reference devices to increase, wherein said current injector injects current while said device current is determined to be below said predetermined threshold.

24. A start-up controller according to claim 23 wherein said voltage proportional to the output voltage of said voltage reference circuit is provided by a voltage divider arranged to provide a fixed proportion of the output voltage.

25. A start-up controller according to claim 23 wherein said voltage proportional to the voltage across said one of the first and second voltage reference devices circuit is provided by a voltage divider arranged to provide a fixed proportion of the said voltage across said one of the first and second voltage reference devices.

26. A start-up controller according to claim 23, wherein one of said first and second voltage reference devices also includes a resistance element in series with it.

27. A start-up controller according to claim 24, wherein one of said first and second voltage reference devices also includes a resistance element in series with it.

28. A start-up controller according to claim 25, wherein one of said first and second voltage reference devices also includes a resistance element in series with it.

29. A start-up controller according to claim 23 wherein said voltage reference devices are p-n junction devices.

30. A start-up controller according to claim 23, wherein said first and second voltage reference devices are bandgap voltage reference devices.

31. A start-up controller for a voltage reference circuit having first and second voltage reference devices, the circuit having a first stable operating state and one or more other stable operating states in which the current flowing through the first and second voltage reference devices is below a predetermined level, the start-up controller comprising:

a current monitor arranged to determine if a device current in one of said voltage reference devices is below a predetermined threshold comprising determining said device current by reference to a voltage across a resistive element in series with said one of said first and second voltage reference devices;

a current injector arranged to inject current to an injection node of said voltage reference circuit to cause the current in said voltage reference device to increase, wherein said current injector injects current while said device current is below said predetermined threshold.

32. A start-up controller according to claim 31 wherein said voltage reference devices are p-n junction devices.

33. A start-up controller according to claim 31, wherein said first and second voltage reference devices are bandgap voltage reference devices.

34. A start-up controller according to claim 23 wherein the current monitor comprises a comparator which includes a predetermined offset.

35. A start-up controller according to claim 31 wherein the current monitor comprises a comparator which includes a predetermined offset.

36. An integrated circuit including a start-up controller according to claim 1.

* * * * *